United States Patent [19]

Henneberger

[11] Patent Number: 4,680,799

[45] Date of Patent: Jul. 14, 1987

[54] HEARING AID

[75] Inventor: Hans Henneberger, Effeltrich, Fed. Rep. of Germany

[73] Assignee: Siemens Aktiengesellschaft, Berlin and Munich, Fed. Rep. of Germany

[21] Appl. No.: 873,146

[22] Filed: Jun. 6, 1986

Related U.S. Application Data

[63] Continuation of Ser. No. 619,521, Jun. 11, 1984, abandoned.

[30] Foreign Application Priority Data

Jun. 27, 1983 [DE] Fed. Rep. of Germany ... 8318579[U]

[51] Int. Cl.[4] ..... H04R 25/02

[52] U.S. Cl. ..... 381/68.6; 381/68.2; 381/69.2

[58] Field of Search ..... 179/107 FD, 107 R, 107 E, 179/178, 179; 381/68, 69, 68.1, 68.2, 68.6, 69.2

[56] References Cited

U.S. PATENT DOCUMENTS

| | | | |
|---|---|---|---|
| 2,987,584 | 11/1958 | Webber et al. | 179/107 E |
| 3,209,082 | 9/1965 | McCarrell | 179/107 E |
| 3,345,737 | 10/1967 | Gordon | 179/107 E |
| 3,529,102 | 9/1970 | Rosenstand | 179/107 E |
| 3,598,928 | 8/1971 | Hickox | 179/107 E |
| 4,152,551 | 5/1979 | Hiller | 179/107 R |
| 4,471,490 | 9/1984 | Bellafiore | 381/69 |
| 4,476,353 | 10/1984 | Haertl | 179/107 E |
| 4,598,177 | 7/1986 | McGroaty et al. | 381/69 |

FOREIGN PATENT DOCUMENTS

| | | | |
|---|---|---|---|
| 0085032 | 8/1983 | European Pat. Off. | 179/107 R |
| 2475389 | 2/1981 | France . | |
| 2070890 | 1/1981 | United Kingdom . | |

*Primary Examiner*—Gene Z. Rubinson
*Assistant Examiner*—Danita R. Byrd
*Attorney, Agent, or Firm*—John Francis Moran

[57] ABSTRACT

A hearing aid has a housing insertable into the auditory canal, wherein the housing contains at least a microphone, an amplifier, an earpiece and a power source. In instruments of this kind it has turned out to be desirable to have, in addition to the usual volume control, an additional control for varying the way the incoming sound signals are influenced by the amplifier (i.e. its characteristic) to adapt to individual hearing impairments. For this purpose the hearing aid provides in the housing space for the battery a pitch control in such a manner that its actuating member can be operated at least when the power source is removed from the instrument. This makes it possible to reduce the space requirement for the pitch control so that even hearing aids insertable into the auditory canal can contain such an additional control.

12 Claims, 5 Drawing Figures

HEARING AID

CROSS-REFERENCE

This is a continuation of Ser. No. 619,521 filed June 11, 1984 now abandoned.

BACKGROUND OF THE INVENTION

The invention relates to a hearing aid which is insertable in the outer auditory canal. A typical hearing aid of this type is disclosed in Great Britain patent application No. 20 70 890.

In hearing aids insertable into the auditory canal, which are referred to as canal hearing aids, the space available for the assembly of the hearing aid components is extremely limited. The configuration of the various parts is therefore very important. In the hearing aid according to Great Britain patent application No. 20 70 890, the largest component (i.e. the power source) is mounted in a depression in the outside wall which terminates the housing towards the outside, in order to place it where the auditory canal usually has its largest diameter. Since this large diameter is usually not very deep, the flat area of the power source was placed parallel to the end wall. But a hinged cover was used for the end wall to obtain a straight outer surface. This, however, has the disadvantage that there is little opportunity to grip the instrument to pull it out of the ear. Moreover, room is lacking for providing, next to the usual volume control, an additional control which permits adaptation of the amplification characteristic of the instrument to an individual hearing impairment, etc.

In instruments disclosed by U.S. Pat. No. 2,987,584 a hinged cover is used for the mounting space of the power source. When this cover is opened, it can serve as a handle to pull the instrument out of the ear. Deviating from the above mentioned approach, clamping the power source inside the housing is not possible in a canal hearing aid because such a holding means requires space on the one hand, and because it is very difficult to remove the power source located inside the housing on the other. Therefore, in other hearing aids such as those disclosed in European patent application E-PA-O 0 085 032, the idea of mounting the battery inside the housing has been abandoned; but this results in the possibility that the battery can get lost when the instrument is pulled out of the ear by its cover. Furthermore, no adjustment of the amplification characteristics is possible in this embodiment.

SUMMARY OF THE INVENTION

It is an object of the invention to provide, in a hearing aid, a configuration of the components which is space saving and which makes possible the accomodation of an additional control.

Due to the use of a hinged cover as a closure for the battery mounting space and also by sinking the cover into the instrument surface the possibility of accomodating in this space the actuating member of a pitch control is possible. This is mainly based on the fact that the mounting space projects into the instrument so that room to mount the actuating member of an adaptation control is available on its wall. One specially advantageous mounting mode, in particular for operating purposes, is obtained by inclining the actuating member because it can then be reached particularly well from the opening of the battery mounting space. Space saving assembly is also possible in that the control itself is mounted to one of the amplifier contact springs. This achieves the result that even in the very small canal hearing aids (i.e. those which virtually disappear in the auditory canal) additional controls can be used without enlarging the face plate.

Other features and advantages of the present invention will become apparent from the following detailed description, and from the claims.

For a full understanding of the present invention, reference should now be made to the following detailed description and to the accompanying drawings.

DETAILED DESCRIPTION

Figure 1:
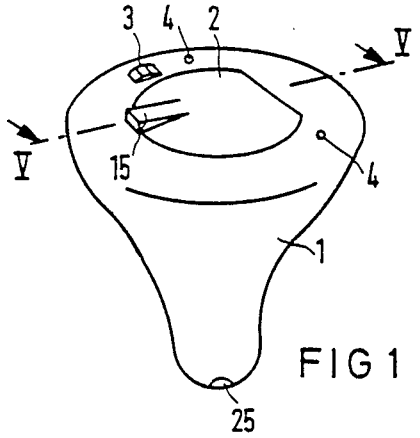
FIG. 1 is a perspective representation of the outside view of a canal hearing aid designed in accordance with the invention.
Figure 2:
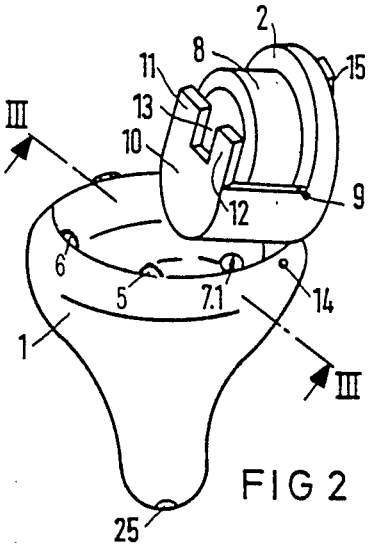
FIG. 2 shows the instrument according to FIG. 1 with the battery compartment cover in the open position.

FIG. 1 shows plastic housing 1 which is shaped to conform to the shape of the auditory canal in which it is to be inserted. It therefore has the shape of an irregular cone. The base of the cone is the large area (face plate) including a cover 2 of a battery compartment (recess), a knob 3 of a volume control and an opening 4 for the entry of sound into the instrument as shown. In the view according to FIG. 2, where cover 2 is shown open, contacts 5 and 6 as well as actuating member 7.1 of pitch control 7 in a recess inside housing 1. On the inside of the cover is a power source, such as a battery 8, fastened to cover 2 by a holder 9 fitting the shape of the battery. Besides its bowlshaped lower part, holder 9 has two tabshaped lugs 11 and 12, mutually spaced as indicated by 13, in continuation of part 10 across the battery surface; lugs 11 and 12 being bent toward cover 2 so as to act like clamps when inserting battery 8 into its holder 9, which retains battery 8. Cover 2 is hinged by a hinge secured by its pin 14. For easier handling, cover 2 has opposite the hinge, a projection 15 which, as is evident from FIG. 1, projects out of the large area of housing 1.

Figure 4:
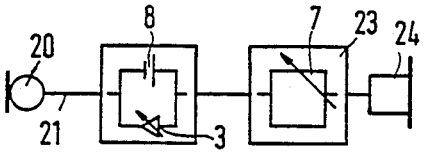
FIG. 4 shows the interaction of the parts in a schematic circuit diagram.
Figure 3:
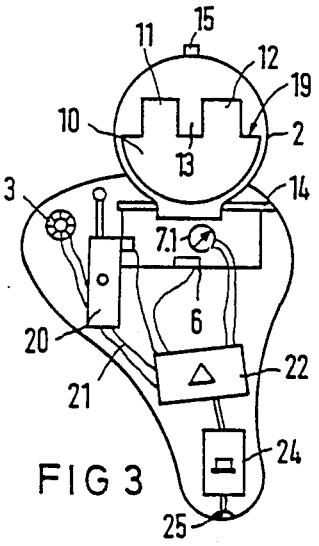
FIG. 3 is a cross sectional view of the configuration of the components accomodated in the housing of the instrument of FIG. 1, which is shown in section along line III—III of FIG. 2.
Figure 5:
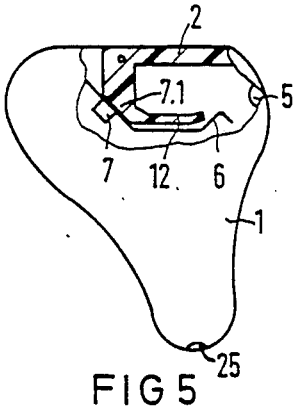
FIG. 5 shows partly in section, a view of the installation of a pitch control along line V—V of FIG. 1.

The operating mode of the instrument is evident from FIGS. 3 and 4. Through opening 4 sound reaches a microphone 20 where it is transduced into electrical signals which arrive at an amplifier 22 via lines 21. This amplifier 22 is powered by battery 8, and its volume is variable through control 3. In addition, coordinated with the amplifier is a network 23, by means of which the desired pitch of the signals to be transmitted is adjustable through an actuating member mounted to the spring of contact 6 in the battery compartment. Provided for the audible output of the sound signals is receiver 24 from which the sound can be conducted to the ear through a canal 25. The instrument is turned on by closing cover 2, thereby causing contacts 5 and 6 of amplifier 22 to engage the battery. Contact 6 is located to occupy space between spring holding tabs 11 and 12 while second contact 5 engages the periphery of battery 8.

There has thus been shown and described a novel hearing aid which fulfills all the objects and advantages sought therefor. Many changes, modifications, variations and other uses and applications of the subject invention will, however, become apparent to those skilled in the art after considering the specification and the accompanying drawings which disclose embodiments thereof. All such changes, modifications, variations and other uses and applications which do not depart from the spirit and scope of the invention are deemed to be covered by the invention which is limited only by the claims which follow.

What is claimed is:

1. A hearing aid with a housing having a shape adapted for insertion into an outer auditory canal which includes a microphone, an amplifier, a receiver and a power source, the housing having a generally frusto-conical shape including a planar base portion serving as an exposed wall when the hearing aid is in the outer auditory canal, the exposed wall having an aperture and cover, the cover adapted to close over the aperture and including retaining means on its inner side for accepting and securing the power source, a recess in the housing adapted to contain the retaining means, said recess being accessible via the aperture, a control having an actuating member mounted in said recess in a location to provide access to the actuating member such that it can be adjusted when the cover is opened.

2. The hearing aid according to claim 1, wherein the cover is pivotably attached at the aperture and the control is located in a sidewall within the recess.

3. The hearing aid according to claim 1, wherein the control is mounted to a contact spring connecting the power source to the amplifier.

4. The hearing aid according to claim 1, wherein the recess includes interior walls and wherein the control actuating member is mounted on an inclined interior wall.

5. A hearing aid of the type having an amplifier within a housing having a generally conical shape suitable for insertion into an outer auditory canal, said housing comprising a base serving as a face plate and being the exposed portion of the housing when inserted into the outer auditory canal; an aperture in said face plate and a recess within the housing accessible via the aperture, the recess having a bottom portion; a cover pivotally mounted for covering the aperture; a power source; the cover having a holder on its inner side adapted to retain the power source such that when the cover is closed, the holder including the power source is located and enclosed in the recess; and a pitch control having an actuating member, said pitch control being mounted to have its actuating member located in the recess to provide access to the actuating member for adjusting when the cover is opened.

6. A hearing aid according to claim 5, wherein the cover is hinged to the housing to provide the pivotal mounting and the power source comprises a battery.

7. A miniature hearing aid of the type having a generally conical shaped housing for insertion into an outer auditory canal, the hearing aid comprising a microphone, an amplifier having an associated volume control, a receiver, and a power source cooperating together to receive and amplify sound impinging on the auditory canal, the generally conical shaped housing having a base serving as an exposed face plate when the hearing aid is located in the auditory canal, the face plate including a pivotably attached cover over an aperture and a recess which is accessed by pivoting the cover in an open position, the cover including holding means for securing the power source on the inner side of the cover, wherein accessing the recess by pivoting the cover also removes the holding means including the power source from the recess, and a pitch control in a location in the recess for controlling the amplifier, and the location being accessible to enable adjustment of the pitch control by opening the cover.

8. A miniature hearing aid according to claim 7, wherein the pivotably attached cover in the open position serves as a grip for removing the hearing aid from the outer auditory canal while the holding means secures the power source to prevent its accidental loss while removing the hearing aid.

9. A hearing aid with a housing having a shape adapted for insertion into an outer auditory canal, the hearing aid including a microphone, an amplifier including at least one control, a receiver and a power source, the housing having a generally conical shape including a planar base portion serving as an exposed wall when the hearing aid is located in the outer auditory canal, the exposed wall having at least one aperture and a cover, the cover adapted to close over one aperture, a recess in the housing adapted to contain the power source when the cover is closed, said recess being accessible via one aperture, and an actuating member mounted in the recess for one control, the actuating member being in an accessible location to enable it to be adjusted when the cover is open and the power source is removed from the recess.

10. The hearing aid according to claim 1, wherein the cover in the closed position is inserted in the exposed wall of the housing and a sloped sidewall within the recess has the actuating member protruding from it.

11. The hearing aid according to claim 3, wherein the contact spring connecting the power source to the amplifier also serves as the support for a sloped sidewall having the control mounted thereon.

12. The hearing aid according to claim 1, wherein the control associated with the actuating member is a pitch control.

* * * * *